US011822278B2

(12) United States Patent
Tokuma

(10) Patent No.: US 11,822,278 B2
(45) Date of Patent: Nov. 21, 2023

(54) IMAGE FORMING APPARATUS

(71) Applicant: CANON KABUSHIKI KAISHA, Tokyo (JP)

(72) Inventor: Naoto Tokuma, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/049,196

(22) Filed: Oct. 24, 2022

(65) Prior Publication Data

US 2023/0126638 A1 Apr. 27, 2023

(30) Foreign Application Priority Data

Oct. 26, 2021 (JP) ..... 2021-175032

(51) Int. Cl.
*G03G 15/20* (2006.01)
*G03G 15/00* (2006.01)
*B65H 29/24* (2006.01)

(52) U.S. Cl.
CPC ..... *G03G 15/657* (2013.01); *B65H 29/242* (2013.01); *G03G 15/2017* (2013.01); *G03G 15/2064* (2013.01); *B65H 2404/264* (2013.01); *B65H 2404/2691* (2013.01); *B65H 2404/281* (2013.01); *B65H 2801/12* (2013.01); *G03G 2215/00679* (2013.01); *G03G 2215/00945* (2013.01)

(58) Field of Classification Search
CPC ..... G03G 15/2017; G03G 15/2064; G03G 15/657
USPC ..... 399/320, 397, 400
See application file for complete search history.

(56) References Cited

U.S. PATENT DOCUMENTS 10,394,177 B2 * 8/2019 Yoshida ..... G03G 21/1647
11,567,433 B2 * 1/2023 Nakamura ..... B65H 5/224

FOREIGN PATENT DOCUMENTS

JP 2012083416 A 4/2012

* cited by examiner

*Primary Examiner* — Hoan H Tran
(74) *Attorney, Agent, or Firm* — Canon U.S.A., Inc. I.P. Division

(57) ABSTRACT

An image forming apparatus includes a transfer unit forming a transfer nip portion, a fixing unit forming a fixing nip portion, and first and second belt suction conveyance units to suck a sheet onto a first belt and a second belt, respectively. The fixing nip portion is arranged at a position above the transfer nip portion. In a sheet conveyance direction, an upstream end portion of the first belt in the first belt suction conveyance unit is provided below the transfer nip portion, a downstream end portion of the first belt is provided above an upstream end portion of the second belt in the second belt suction conveyance unit, and a downstream end portion of the second belt is provided below the fixing nip portion. The first and second belts are inclined from a lower position to an upper position from upstream to downstream in the sheet conveyance direction.

7 Claims, 5 Drawing Sheets

IMAGE FORMING APPARATUS

BACKGROUND

Field

The present disclosure relates to an image forming apparatus that forms an image on a sheet.

Description of the Related Art

Conventionally, an electrophotographic image forming apparatus includes a transfer unit that transfers an image to a sheet, a fixing unit that fixes the transferred image on the sheet, and a belt suction conveyance unit that sucks the sheet onto a belt by a fan and conveys the sheet as discussed in Japanese Patent Application Laid-Open No. 2012-083416.

Some conventional image forming apparatuses have a belt suction surface arranged below a transfer nip portion and a fixing nip portion. The belt suction surface in a sheet conveyance direction is arranged so that an upstream end and a downstream end of the belt suction surface are at substantially the same height.

However, recently, there has been a demand for an image forming apparatus with high image quality and high productivity. Particularly, the image forming apparatus is required to convey a sheet with high productivity regardless of a type of sheet (a thick sheet, a thin sheet, etc.). In order to fix an image on a sheet at high speed regardless of the thickness of the sheet, it is necessary to stably supply an appropriate amount of heat to the sheet. To this end, a size of a fixing unit increases. As an exemplification, a fixing roller on a non-image side (a lower side) of a sheet in the fixing nip portion needs a cooling unit for cooling the roller so that the roller is not overheated.

In a case where it is intended to arrange devices of an image forming apparatus including the large-size fixing unit while preventing the image forming apparatus from becoming large in size, it is conceivable that a sheet fixing nip portion is arranged above a transfer nip portion in the fixing unit. However, the conventional technique does not take into consideration stable conveyance of a sheet by a belt suction conveyance unit from a transfer unit to the fixing unit in the case where the fixing nip portion is arranged above the transfer nip portion.

SUMMARY

The present disclosure is directed to provision of an image forming apparatus that can provide a deliverable with high image quality at high productivity and can stably convey a sheet to which a toner image is transferred to a fixing unit.

According to an aspect of the present disclosure, an image forming apparatus includes a transfer unit configured to form a transfer nip portion for nipping and conveying a sheet and to transfer an image to the sheet, a fixing unit provided downstream of the transfer unit in a sheet conveyance direction and configured to form a fixing nip portion for nipping and conveying a sheet and to fix the image transferred to the sheet by the transfer unit, a first belt suction conveyance unit provided between the transfer unit and the fixing unit in the sheet conveyance direction and configured to suck a sheet onto a first belt and convey the sheet, and a second belt suction conveyance unit provided between the first belt suction conveyance unit and the fixing unit in the sheet conveyance direction and configured to suck a sheet onto a second belt and convey the sheet, wherein the fixing nip portion is arranged at a position above the transfer nip portion, wherein, in the sheet conveyance direction, an upstream end portion of the first belt in the first belt suction conveyance unit is provided below the transfer nip portion, a downstream end portion of the first belt in the first belt suction conveyance unit is provided above an upstream end portion of the second belt in the second belt suction conveyance unit, and a downstream end portion of the second belt in the second belt suction conveyance unit is provided below the fixing nip portion, and wherein the first belt in the first belt suction conveyance unit and the second belt in the second belt suction conveyance unit are inclined from a lower position to an upper position from upstream to downstream in the sheet conveyance direction.

Further features of the present disclosure will become apparent from the following description of exemplary embodiments with reference to the attached drawings.

DESCRIPTION OF THE EMBODIMENTS

Exemplary embodiments of the present disclosure will be described in detail below with reference to the attached drawings.

<Image Forming Apparatus>

Figure 1:
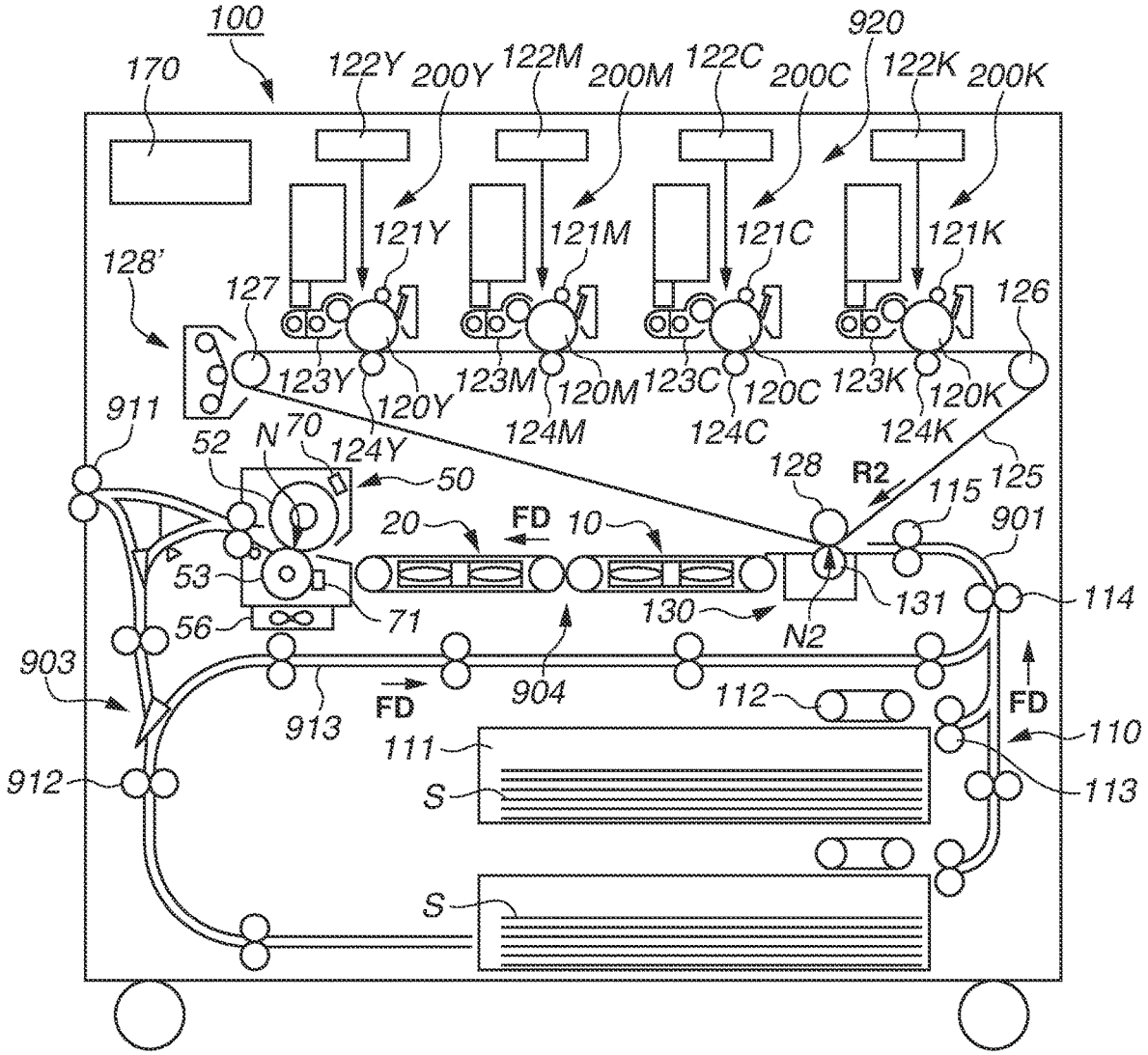
FIG. 1 is a schematic diagram of a configuration of an image forming apparatus according to a first exemplary embodiment.

FIG. 1 is a schematic diagram of a configuration of an image forming apparatus 100 according to a first exemplary embodiment. First, the configuration of the image forming apparatus 100 is described with reference to FIG. 1. The image forming apparatus 100 can be divided into a sheet conveyance unit that mainly conveys a sheet and an image forming unit that forms an image on the conveyed sheet. The sheet conveyance unit mainly includes a feeding unit 110 that feeds a sheet, a registration unit that controls a start of conveyance of the sheet, and a post conveyance unit 903 that conveys the sheet on which a toner image has been fixed. Meanwhile, the image forming unit mainly includes an image forming unit 920 that forms a toner image, a belt suction conveyance unit 904 that sucks the sheet to which the toner image has been transferred onto a belt and conveys the sheet, and a fixing unit 50 that fixes the transferred toner image on the sheet.

First, the image forming unit that forms an image on a sheet is described. The image forming unit 920, which is a part of the image forming unit, adopts a tandem system in which electrophotographic image forming stations 200Y, 200M, 200C, and 200K for respectively forming yellow (Y), magenta (M), cyan (C), and black (B) toner images are arranged in series.

Configurations of the image forming stations 200Y, 200M, 200C, and 200K are common except that respective toner colors are different. Thus, the configuration of the image forming station 200Y is described here as an example, and descriptions of the configurations of the image forming stations 200M, 200C, and 200K are omitted. In FIG. 1, the configurations of the image forming stations 200Y, 200M, 200C, and 200K are indicated by adding "Y", "M", "C", and "K", respectively, to the end of reference numerals. The image forming station 200Y includes a photosensitive drum 120Y, a primary charging device 121Y, an exposure device 122Y, and a development device 123Y.

The image forming unit 920 further includes an intermediate transfer belt 125 as an image bearing member on which the toner images visualized by the image forming stations 200Y, 200M, 200C, and 200K are carried. The intermediate transfer belt 125 is supported in a state of being stretched around a drive roller 126, a tension roller 127, and an inner transfer roller 128 and is rotated in a direction of an arrow R2 in FIG. 1 by drive of the drive roller 126.

A secondary transfer roller 131 is pressed against and brought into contact with the intermediate transfer belt 125, which is supported from the inner side of the intermediate transfer belt 125 by the inner transfer roller 128, and forms a transfer nip portion N2 (also referred to as a secondary transfer nip portion N2) with the intermediate transfer belt 125. The secondary transfer roller 131, the intermediate transfer belt 125, and the inner transfer roller 128 form a secondary transfer unit 130 serving as a transfer unit according to the present exemplary embodiment. A cleaning device 128' rubs the intermediate transfer belt 125 with a cleaning web and removes transfer residual toner, paper dust, and the like remaining on a surface of the intermediate transfer belt 125 that has passed through the transfer nip portion N2.

The configuration of the image forming unit 920 has been described above. Next, a series of procedures of an image forming process of forming an image on a sheet is described. First, the exposure device 122Y exposes the photosensitive drum 120Y to light and forms an electrostatic latent image on a surface of the photosensitive drum 120Y based on an image forming job input to the image forming apparatus 100. The electrostatic latent image on the photosensitive drum 120Y is developed by the development device 123Y and visualized as a toner image. The toner image carried on the surface of the photosensitive drum 120Y is primarily transferred to the intermediate transfer belt 125 by a primary transfer device 124Y. A plurality of toner images carried on surfaces of the photosensitive drums 120Y, 120M, 120C, and 120K are transferred to the intermediate transfer belt 125 so as to be superimposed on each other, and a full color toner image is formed. The toner image primarily transferred to the intermediate transfer belt 125 is secondarily transferred to a sheet S fed from the feeding unit 110 at the transfer nip portion N2 according to the present exemplary embodiment. The intermediate transfer belt 125 is rotationally driven by the drive roller 126 that rotates at a constant speed, and is rotated in a state where the circumferential speed (rotational speed) thereof is maintained at a constant transfer speed. Thus, a sheet conveyance speed at the transfer nip portion N2 is the circumferential speed of the intermediate transfer belt 125. Hereinafter, the sheet conveyance speed at the secondary transfer unit 130 is referred to as "transfer speed VT". The transfer speed VT is a sheet conveyance speed at the time of transferring of the toner image in the secondary transfer unit 130. As described above, the toner image formed by the image forming unit 920 is transferred to the sheet.

Next, the sheet to which the toner image is transferred is conveyed toward the fixing unit 50 to have the toner image fixed on the sheet. In the present exemplary embodiment, the belt suction conveyance unit 904 is arranged between the secondary transfer unit 130 and the fixing unit 50 in a sheet conveyance direction FD. The belt suction conveyance unit 904 includes a first belt suction conveyance unit 10 arranged on an upstream side in the sheet conveyance direction FD and a second belt suction conveyance unit 20 arranged on a downstream side in the sheet conveyance direction FD. The fixing unit 50 is provided downstream of the secondary transfer unit 130 in the sheet conveyance direction FD. The fixing unit 50 fixes a toner image on a sheet by heat and pressure. The fixing unit 50 includes a heating roller 52 that is provided with a heater inside and a pressure roller 53 that is arranged to be able to come into contact with the heating roller 52 and forms a fixing nip portion N together with the heating roller 52. The fixing unit 50 melts the toner image transferred to the sheet, and thus the toner image is fixed on the sheet. The configurations of the belt suction conveyance unit 904 and the fixing unit 50 are described in detail below.

Next, the sheet conveyance unit is described. The feeding unit 110 includes a sheet cassette 111 that stores a sheet, a pickup roller 112 that picks up the sheet from the sheet cassette 111, and a separation device 113 that separates and feeds the sheet picked up by the pickup roller 112. The feeding unit 110 further includes a delivery roller 114 and a registration roller 115 that convey the sheet in a feeding conveyance path 901 in which the sheet separated and fed by the separation device 113 is conveyed.

The registration roller 115 is made to stand by in a state in which rotation is stopped and a leading edge of the sheet S is brought into contact therewith, and conveys the sheet S toward the transfer nip portion N2 in synchronization with a timing at which the toner image formed on the intermediate transfer belt 125 is conveyed. The sheet S carrying the toner image transferred thereto at the transfer nip portion N2 is conveyed from the transfer nip portion N2 to the fixing unit 50 by the belt suction conveyance unit 904. In the fixing unit 50, the sheet S is nipped by the fixing nip portion N, and heat and pressure are applied to an unfixed toner image to fix the toner image on the sheet S. The sheet S sent out from the fixing unit 50 is discharged to the outside of the image forming apparatus 100 by a discharge roller 911 in the post conveyance unit 903. The post conveyance unit 903 also includes a reversing roller 912 for reversing and conveying the sheet, and a two-sided conveyance path 913 that conveys the sheet reversed by the reversing roller 912 and joins the feeding conveyance path 901. In a case where images are to be formed on both sides of the sheet S, the sheet S sent out from the fixing unit 50 is conveyed to the reversing roller 912, reversed by the reversing roller 912, and then conveyed toward the two-sided conveyance path 913. Then, the sheet S is conveyed again to the feeding conveyance path 901 via the two-sided conveyance path 913, and a toner image is formed on a second surface (a back surface) of the sheet S in the same manner as a first surface (a front surface).

As described above, the image forming apparatus 100 according to the present exemplary embodiment can alternately execute an image forming process by the image forming unit and a sheet conveyance process by the sheet conveyance unit and generate the sheet S on which the image is formed as a deliverable.

<Detailed Configuration from Transfer Unit to Fixing Unit>

Figure 2:
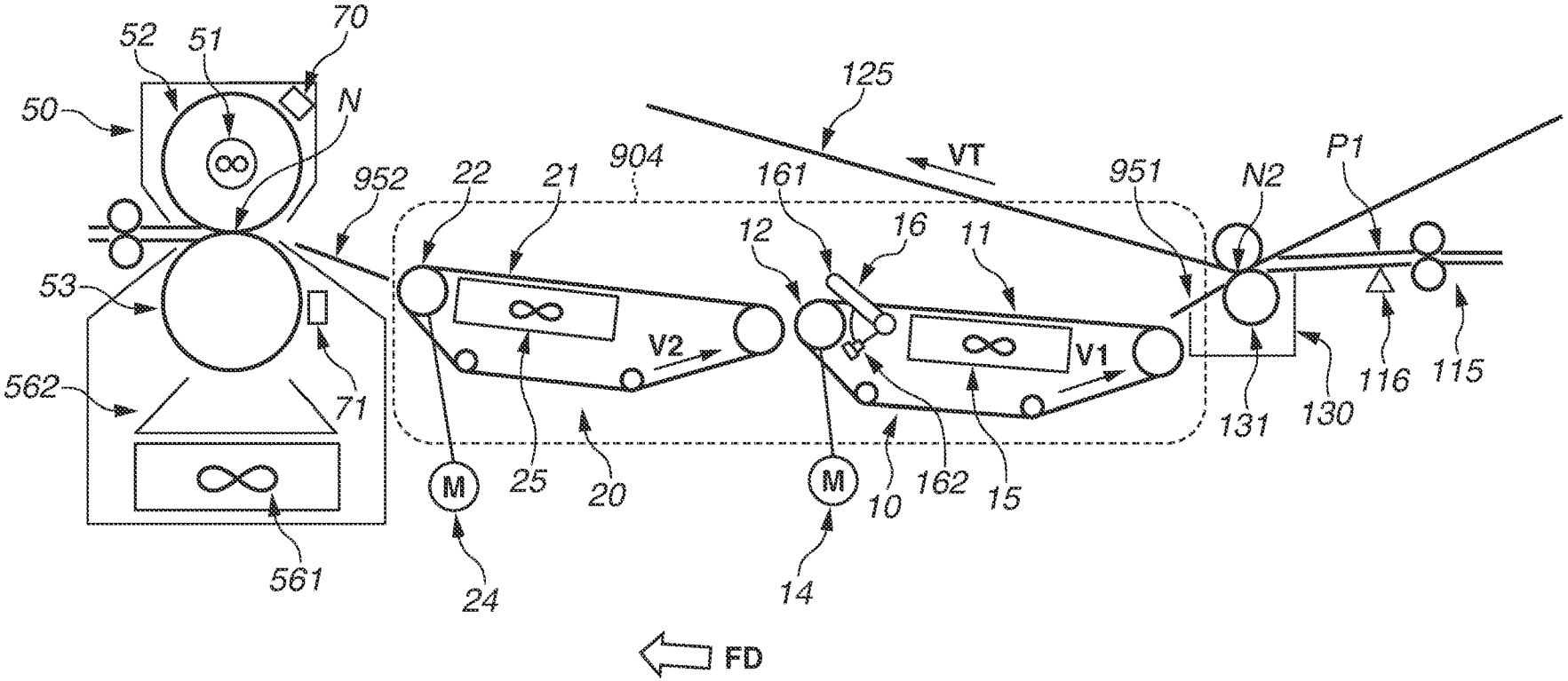
FIG. 2 is a cross-sectional view of a secondary transfer unit, a belt suction conveyance unit, and a fixing unit according to the first exemplary embodiment.
Figure 3:
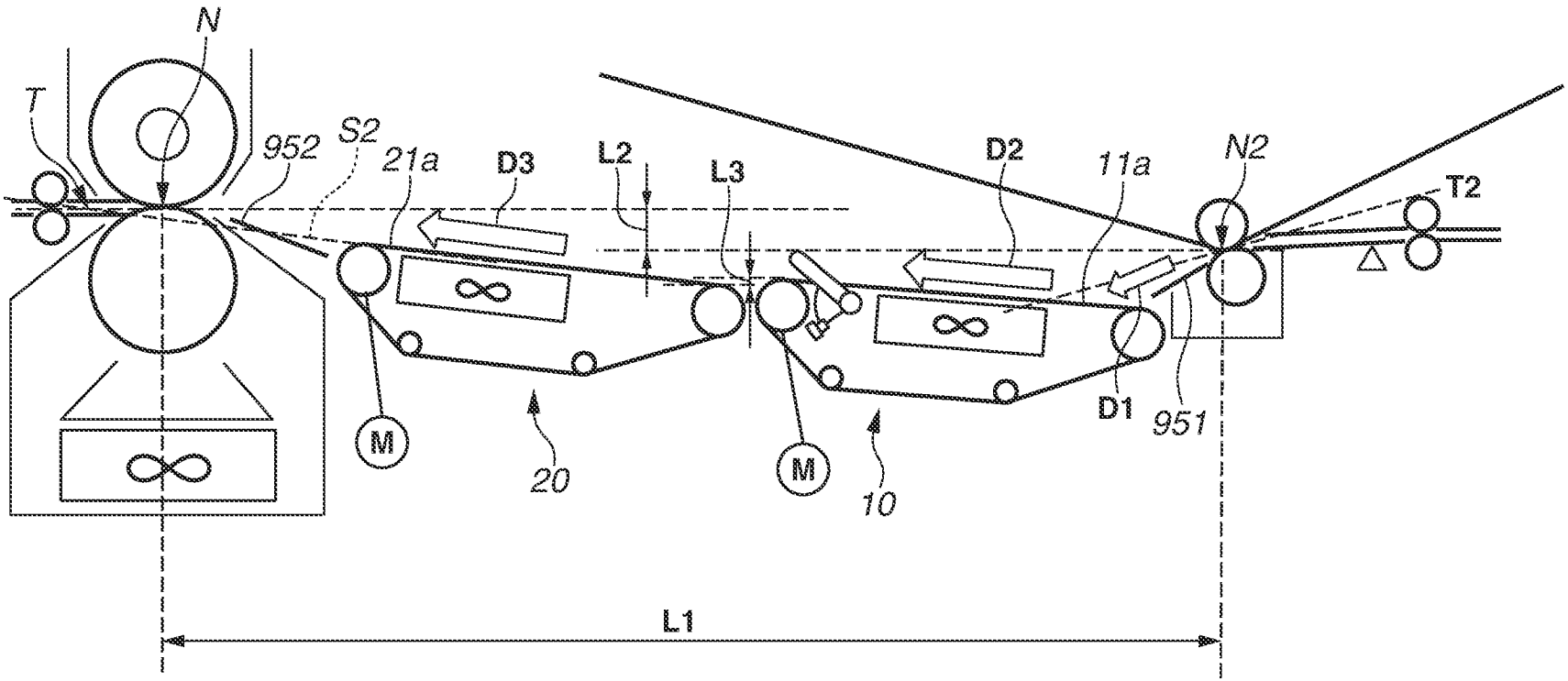
FIG. 3 is a cross-sectional view illustrating a positional relationship among the secondary transfer unit, the belt suction conveyance unit, and the fixing unit according to the first exemplary embodiment.
Figure 4:
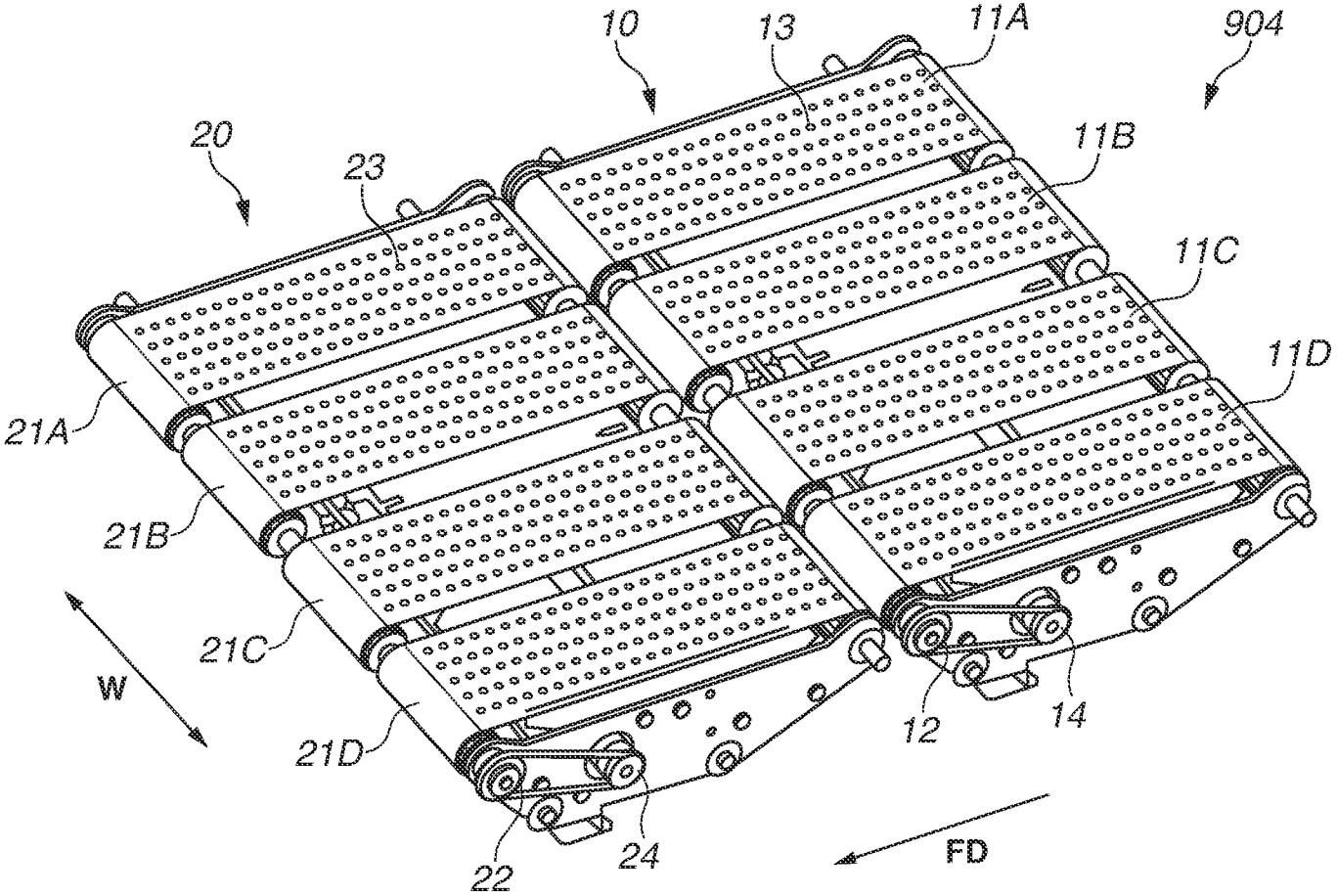
FIG. 4 is a perspective view of the belt suction conveyance unit according to the first exemplary embodiment.
Figure 5:
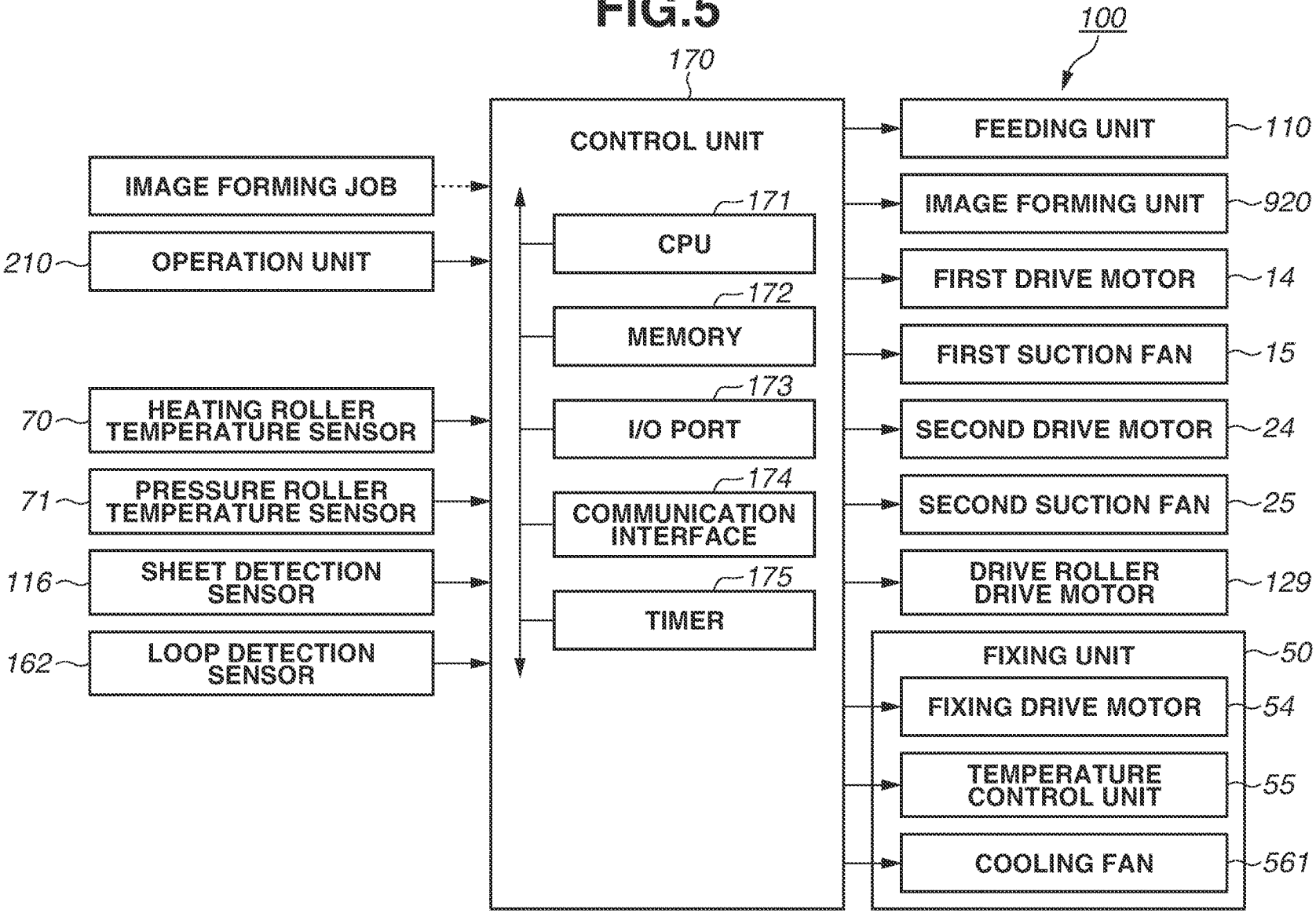
FIG. 5 is a control block diagram of the image forming apparatus according to the first exemplary embodiment.

FIGS. 2 and 3 are cross-sectional views of the secondary transfer unit 130, the belt suction conveyance unit 904, and the fixing unit 50. FIG. 4 is a perspective view of the belt suction conveyance unit 904. FIG. 5 is a control block diagram of the image forming apparatus 100.

As illustrated in FIG. 2, the belt suction conveyance unit 904 serving as a belt suction conveyance unit according to the present exemplary embodiment includes the first belt suction conveyance unit 10 and the second belt suction conveyance unit 20. The first belt suction conveyance unit 10 is arranged downstream of the transfer nip portion N2 in the sheet conveyance direction FD, and the second belt suction conveyance unit 20 is arranged downstream of the first belt suction conveyance unit 10 and upstream of the fixing nip portion N. In the sheet conveyance direction FD, a post-transfer guide 951 that guides the sheet conveyed from the transfer nip portion N2 toward the first belt suction conveyance unit 10 is provided between the first belt suction conveyance unit 10 and the transfer nip portion N2. Further, in the sheet conveyance direction FD, a pre-fixing guide 952 for guiding the sheet conveyed by the second belt suction conveyance unit 20 to the fixing nip portion N is provided between the second belt suction conveyance unit 20 and the fixing nip portion N.

The first belt suction conveyance unit 10 includes a first conveyance belt 11 serving as a first belt according to the present exemplary embodiment, and a first drive roller 12 and driven rollers around which the first conveyance belt 11 is stretched in a rotatable manner. The first drive roller 12 and the driven rollers constitute a first tension member according to the present exemplary embodiment. The first belt suction conveyance unit 10 further includes a first drive motor 14 that rotates the first drive roller 12 to rotate the first conveyance belt 11. The first conveyance belt 11 is an endless belt in which a large number of holes 13 are formed and is a member having air permeability that allows air to pass through the holes 13 to the inner side and outer side of a circumferential surface of the first conveyance belt 11. A first suction fan 15 that sucks the sheet onto the circumferential surface of the first conveyance belt 11 is arranged on the inner side of the circumferential surface of the first conveyance belt 11. The first suction fan 15 sucks air from the outer side to the inner side of the circumferential surface of the first conveyance belt 11 through the large number of holes 13 formed in the first conveyance belt 11, and can apply a suction force for conveying the sheet to the circumferential surface of the first conveyance belt 11. The first suction fan 15 constitutes a first air suction unit according to the present exemplary embodiment.

The second belt suction conveyance unit 20 includes a second conveyance belt 21 serving as a second belt according to the present exemplary embodiment, and a second drive roller 22 and driven rollers around which the second conveyance belt 21 is stretched in a rotatable manner. The second drive roller 22 and the driven rollers constitute a second tension member according to the present exemplary embodiment. The second belt suction conveyance unit 20 further includes a second drive motor 24 that rotates the second drive roller 22 to rotate the second conveyance belt 21. The second conveyance belt 21 is an endless belt in which a large number of holes 23 are formed and is a member having air permeability that allows air to pass through the holes 23 to the inner side and outer side of a circumferential surface of the second conveyance belt 21. A second suction fan 25 that sucks the sheet onto the circumferential surface of the second conveyance belt 21 is arranged on the inner side of the circumferential surface of the second conveyance belt 21. A central position of the second suction fan 25 may be arranged downstream of a center of the second conveyance belt 21 in the sheet conveyance direction FD. With this configuration, the sheet can be conveyed to the fixing nip portion N in a state in which the sheet is brought close to a second belt surface 21*a*. The second suction fan 25 sucks air from the outer side to the inner side of the circumferential surface of the second conveyance belt 21 through the large number of holes 23 formed in the second conveyance belt 21, and can apply a suction force for conveying the sheet to the circumferential surface of the second conveyance belt 21. The second suction fan 25 constitutes a second air suction unit according to the present exemplary embodiment.

A sheet detection sensor 116 that detects the sheet is provided between the registration roller 115 and the transfer nip portion N2 in the sheet conveyance direction FD. The sheet detection sensor 116 detects presence or absence of the sheet at a detection position P1 between the registration roller 115 and the transfer nip portion N2 in the sheet conveyance direction FD. A signal output by the sheet detection sensor 116 is transmitted to a control unit 170 (refer to FIG. 5).

The fixing unit 50 further includes a heating roller temperature sensor 70 that detects a surface temperature of the heating roller 52, and a pressure roller temperature sensor 71 that detects a surface temperature of the pressure roller 53. The heating roller temperature sensor 70 and the pressure roller temperature sensor 71 are provided to maintain the surface temperature of the heating roller 52 and the surface temperature of the pressure roller 53, respectively, at appropriate temperatures. An air volume of a cooling fan 561 is adjusted in response to a readout of the pressure roller temperature sensor 71 so that the surface temperature of the pressure roller 53 is controlled to be constant. Accordingly, a deliverable with high image quality and high productivity can be achieved.

A cooling unit 56 for cooling the pressure roller 53 is provided below the fixing unit 50. The cooling unit 56 includes the cooling fan 561 and a cooling duct 562 for uniformly applying the air from the cooling fan 561 to the pressure roller 53 in a longitudinal direction. In order to maintain the high image quality and high productivity of the image forming apparatus 100, the cooling fan 561 is required to provide a large amount of air, and thus is larger than the first suction fan 15 and the second suction fan 25 used in the belt suction conveyance unit 904. In addition, in order to avoid an image defect in a main scanning direction, which is a width direction of the sheet, it is necessary to keep temperature distribution in the longitudinal direction of the pressure roller 53 uniform. Thus, the cooling duct 562 is also large.

<Arrangement Relationship Among Transfer Unit, Belt Suction Conveyance Unit, and Fixing Unit>

Next, an arrangement relationship among the transfer nip portion N2, the belt suction conveyance unit 904, and the fixing nip portion N is described with reference to FIG. 3.

First, the fixing nip portion N is arranged above the secondary transfer nip portion N2 (by a level difference L2 in FIG. 3). This is because a large area is required below the fixing unit 50, and a space for sheet jam recovery in the two-sided conveyance path 913 needs to be secured. As described above, it is necessary to arrange the cooling unit 56 for cooling the pressure roller 53, which forms the fixing nip portion N, below the fixing unit 50.

As illustrated in FIG. 1, the two-sided conveyance path 913 is arranged below the transfer unit, the belt suction conveyance unit 904, and the fixing unit 50. Thus, if the fixing unit 50 and the cooling unit 56 are arranged in an upper part of the image forming apparatus 100, user's workability in sheet jam recovery in the two-sided conveyance path 913 can be improved. In other words, the space for sheet jam recovery is enlarged to improve the workability. In contrast, in order to prevent deterioration of the user's sheet jam recovery workability due to arrangement of the two-sided conveyance path 913 in a lower part of the image forming apparatus 100, it is also conceivable to move only a portion of the two-sided conveyance path 913 immediately below the fixing unit 50 downward, and move upstream and downstream portions thereof upward. However, a curvature radius of a bend portion of a sheet conveyance path is small, i.e., curvature of the conveyance path becomes large for sheet conveyance. In this case, there is a possibility that a highly rigid sheet such as a thick sheet cannot be conveyed, or an image defect occurs even if the sheet is conveyed. Thus, it is conceivable to move both the fixing unit 50 and the secondary transfer unit 130 upward, but as illustrated in FIG. 1, a primary transfer unit and a toner cartridge are arranged above the secondary transfer unit 130. Accordingly, a position of the toner cartridge also becomes higher, and replacement workability of a user may be deteriorated. Thus, in the present exemplary embodiment, the fixing nip portion N is arranged above the transfer nip portion N2. The cooling unit 56 is arranged below the fixing unit 50 and above the two-sided conveyance path 913.

As illustrated in FIG. 3, a nip line T2 in the secondary transfer nip portion N2 is formed to incline slightly downward (in a D1 direction in FIG. 3). This is to prevent a separation failure of a thin sheet or the like from the intermediate transfer belt 125. In a case where the secondary transfer nip portion N2 has a horizontal or upward nip line, i.e., an abutting angle thereof with respect to the intermediate transfer belt 125 is small, the separation failure occurs in which a leading edge of the thin sheet sticks to the intermediate transfer belt 125 and is discharged upward without being separated. Particularly, in a case where an apparatus handles a thin sheet, the nip line in the secondary transfer nip portion N2 generally inclines downward in a direction away from the intermediate transfer belt 125.

In order to receive the sheet discharged downward from the transfer nip portion N2, an upstream end portion of a first belt surface 11*a* of the first belt suction conveyance unit 10 is arranged below the secondary transfer nip portion N2. Further, in order to convey the sheet from the secondary transfer nip portion N2 to the fixing nip portion N located above the secondary transfer nip portion N2, a downstream end portion of the first belt surface 11*a* of the first belt suction conveyance unit 10 is arranged above the upstream end portion of the first belt surface 11*a*. In other words, a sheet conveyance angle of the first belt in the first belt suction conveyance unit 10 is upward (in a D2 direction in FIG. 3). In other words, a conveyance surface (an upper surface of the first belt surface 11*a*) on which the first belt suction conveyance unit 10 sucks and conveys the sheet is inclined with respect to the horizontal. Specifically, the conveyance surface (the upper surface of the first belt surface 11*a*) on which the first belt suction conveyance unit 10 sucks and conveys the sheet is inclined upward in a direction from the secondary transfer nip portion N2 to the fixing nip portion N.

Similarly, an upstream end portion of the second belt surface 21*a* of the second belt suction conveyance unit 20 is arranged at a position below the downstream end portion of the first belt surface 11*a* of the first belt suction conveyance unit 10 and has a level difference L3 in order to receive the sheet from the first belt suction conveyance unit 10. Further, a downstream end portion of the second belt surface 21*a* of the second belt suction conveyance unit 20 is arranged at a position above the upstream end portion of the second belt surface 21*a* in order to pass the sheet to the fixing nip portion N located above the secondary transfer nip portion N2. In other words, a sheet conveyance angle of the second belt in the second belt suction conveyance unit 20 is also upward as in the case of the first belt suction conveyance unit 10 (in a D3 direction in FIG. 3). In other words, a conveyance surface (an upper surface of the second belt surface 21*a*) on which the second belt suction conveyance unit 20 sucks and conveys the sheet is inclined with respect to the horizontal. Specifically, the conveyance surface (the upper surface of the second belt surface 21*a*) on which the second belt suction conveyance unit 20 sucks and conveys the sheet is inclined upward in the direction from the secondary transfer nip portion N2 to the fixing nip portion N. The upstream end portion and the downstream end portion of the first belt surface 11*a* and the upstream end portion and the downstream end portion of the second belt surface 21*a* are the upstream end portion and the downstream end portion on the sheet conveyance surface of each of the belts.

A virtual line S2 on the second belt surface 21*a* of the second belt suction conveyance unit 20 in the sheet conveyance direction intersects the pre-fixing guide 952. Accordingly, the leading edge of the sheet conveyed from the second belt suction conveyance unit 20 to the fixing unit 50 inevitably abuts on the pre-fixing guide 952, and an orientation of the sheet conforms to the pre-fixing guide 952, so that the sheet is conveyed to the fixing nip portion N. Thus, it is possible to avoid an image defect caused by unfixed toner on the sheet coming into contact with the heating roller 52. The virtual line S2 intersects a fixing nip line T downstream of the fixing nip portion N in the sheet conveyance direction. In the present exemplary embodiment, the fixing nip line T is set to be substantially horizontal.

<Loop Control Between Transfer Unit and Fixing Unit>

As illustrated in FIG. 2, the first belt suction conveyance unit 10 includes a loop detection unit 16.

The loop detection unit 16 includes a loop detection flag 161 that swings based on a height of the conveyed sheet S. The loop detection flag 161 projects from the first belt surface 11*a* of the first conveyance belt 11, comes in contact with the sheet S, and thus detects the height of the sheet S, i.e., a loop amount to be formed on the sheet between the secondary transfer nip portion N2 and the fixing nip portion N.

The loop detection unit 16 includes a loop detection sensor 162 such as a photointerrupter that switches between a light shielding state and a light transmitting state based on a swing angle of the loop detection flag 161 and outputs an on or off signal. Accordingly, in a case where the loop detection flag 161 is at a predetermined height or more, i.e., the loop amount is less than a predetermined amount, a speed of a fixing drive motor 54 is reduced to increase the loop amount. On the contrary, in a case where the loop detection flag 161 is less than the predetermined height, i.e., the loop amount is the predetermined amount or more, the speed of the fixing drive motor 54 is increased to reduce the loop amount. The heating roller 52 and the pressure roller 53 are rotationally driven by the fixing drive motor 54 such as a direct-current (DC) brushless motor. More specifically, changing the speed of the fixing drive motor 54 can change the sheet conveyance speed at the fixing nip portion N. The loop control is performed as described above, and thus the orientation of the sheet can be maintained constant between the secondary transfer nip portion N2 and the fixing nip portion N.

In the present exemplary embodiment, a distance L1 between the transfer nip portion N2 and the fixing nip portion N is set to 19 inches (483 mm) or more, or approximately 500 mm. In a case where a length of a sheet in the sheet conveyance direction FD is 19 inches or less, the sheet is conveyed without being nipped by both the transfer nip portion N2 and the fixing nip portion N. In other words, in a case of a sheet length of 19 inches, the secondary transfer nip portion N2 and the fixing nip portion N do not nip the sheet at the same time, so that it is possible to avoid an image defect caused by the fixing nip portion N pulling the sheet with respect to the transfer nip portion N2 and to provide a high image quality and highly precise deliverable. On the other hand, in a case where the sheet length exceeds 19 inches, or a sheet generally referred to as a long sheet is used, the secondary transfer nip portion N2 and the fixing nip portion N nip the sheet at the same time and convey the sheet while performing the above-described loop control, so that it is possible to avoid an image defect and to provide a high image quality and highly precise deliverable.

As described above, in the present exemplary embodiment, the fixing nip portion N is arranged above the transfer nip portion N2. In addition, the nip line T2 in the secondary transfer nip portion N2 is arranged to incline downward. The upstream end portion of the first belt in the first belt suction conveyance unit 10 that receives the sheet S discharged from the transfer unit is arranged below the transfer nip portion N2. The upstream end portion of the second belt in the second belt suction conveyance unit 20 is arranged below the downstream end portion of the first belt in the first belt suction conveyance unit 10.

The downstream end portion of the second belt in the second belt suction conveyance unit 20 is arranged below the fixing nip portion N. The first belt in the first belt suction conveyance unit 10 and the second belt in the second belt suction conveyance unit 20 are arranged to incline upward from the upstream to the downstream in the sheet conveyance direction.

With the above-described configuration, the present exemplary embodiment can provide both the following functions and performances. First, the nip line T2 in the secondary transfer nip portion N2 is arranged to be in a downward direction, and thus the separation performance with respect to thin paper in the secondary transfer unit 130 can be secured. Second, the first belt suction conveyance unit 10 is arranged below the secondary transfer nip portion N2, and the upstream end portion of the second belt is arranged below the downstream end portion of the first belt, so that stable sheet conveyance by the belt can be achieved. Third, when a sheet is conveyed from the second belt suction conveyance unit 20 to the fixing unit 50, a leading edge of the sheet is brought into contact with the pre-fixing guide 952, and thus an image defect can be avoided. Fourth, the fixing nip portion N is arranged above the transfer nip portion N2, and thus a space can be secured below the fixing unit 50. Thus, the pressure roller 53 can be stably cooled, and a deliverable can be provided with high image quality and high productivity. Fifth, since the fixing nip portion N is arranged above the transfer nip portion N2, a space for sheet jam recovery in the two-sided conveyance path 913 can be secured. Sixth, a gently downward convex conveyance path can be formed from the secondary transfer unit 130 to the fixing unit 50, so that the loop control can be performed. In other words, a deliverable with high image quality can be provided in the case of a long sheet that is nipped by both the secondary transfer unit 130 and the fixing unit 50 at the same time.

In the present exemplary embodiment, the first belt suction conveyance unit and the second belt suction conveyance unit are separated. This is because of the workability in sheet jam recovery. There is an issue in the workability in the sheet jam recovery in a case where one connected belt suction conveyance unit is used. In a case where a sheet is jammed in the belt suction conveyance unit, it is desirable to handle the sheet in a state in which a unit in a periphery of the belt suction conveyance unit is pulled out. Meanwhile, in the case where the unit is pulled out, positioning of the unit may vary, and sheet conveyance accuracy may be deteriorated in a boundary portion of the pulled out unit. Since an orientation of a sheet in the secondary transfer unit that transfers an image to the sheet is very delicate, it is necessary that the secondary transfer unit is in a highly accurate mutual positional relationship with the upstream and downstream units. In addition, since the orientation of the sheet entering the fixing unit is very important for high image quality, it is necessary that the fixing unit and the upstream suction conveyance unit (the second belt suction conveyance unit) are in a highly accurate mutual positional relationship. In other words, it is necessary to pull out the unit to handle the sheet, and it is necessary that the secondary transfer unit and the suction conveyance unit immediately downstream (the first belt suction conveyance unit), and the fixing unit and the upstream suction conveyance unit (the second belt suction conveyance unit) are in the highly accurate mutual positional relationships. Therefore, it is necessary that the first belt suction conveyance unit and the second belt suction conveyance unit are separate units (a single long belt suction conveyance unit is not a good form). In the present exemplary embodiment, two belt suction conveyance units are used, but the belt suction conveyance unit may be further divided into three or the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-175032, filed Oct. 26, 2021, which is hereby incorporated by reference herein in its entirety.

What is claimed is:

1. An image forming apparatus comprising:

a transfer unit configured to form a transfer nip portion for nipping and conveying a sheet and to transfer an image to the sheet;

a fixing unit provided downstream of the transfer unit in a sheet conveyance direction and configured to form a fixing nip portion for nipping and conveying a sheet and to fix the image transferred to the sheet by the transfer unit;

a first belt suction conveyance unit provided between the transfer unit and the fixing unit in the sheet conveyance direction and configured to suck a sheet onto a first belt and convey the sheet; and a second belt suction conveyance unit provided between the first belt suction conveyance unit and the fixing unit in the sheet conveyance direction and configured to suck a sheet onto a second belt and convey the sheet, wherein the fixing nip portion is arranged at a position above the transfer nip portion, wherein, in the sheet conveyance direction, an upstream end portion of the first belt in the first belt suction conveyance unit is provided below the transfer nip portion, a downstream end portion of the first belt in the first belt suction conveyance unit is provided above an upstream end portion of the second belt in the second belt suction conveyance unit, and a downstream end portion of the second belt in the second belt suction conveyance unit is provided below the fixing nip portion, and wherein the first belt in the first belt suction conveyance unit and the second belt in the second belt suction conveyance unit are inclined from a lower position to an upper position from upstream to downstream in the sheet conveyance direction.

2. The image forming apparatus according to claim 1, wherein a nip line in the transfer nip portion extends in a direction that inclines downward toward the downstream in the sheet conveyance direction, and intersects the first belt in the first belt suction conveyance unit, and wherein a tangent line in contact with a belt surface of the second belt in the second belt suction conveyance unit and a nip line in the fixing nip portion intersect downstream of the fixing nip portion.

3. The image forming apparatus according to claim 1, wherein the downstream end portion of the second belt in the sheet conveyance direction is provided above the downstream end portion of the first belt in the sheet conveyance direction.

4. The image forming apparatus according to claim 1, further comprising a cooling unit provided below the fixing unit and configured to cool the fixing unit.

5. The image forming apparatus according to claim 4, wherein the fixing unit includes a heating roller and a pressure roller placed at a position facing the heating roller and forms the fixing nip portion, and wherein the cooling unit is configured to cool the pressure roller.

6. The image forming apparatus according to claim 1, further comprising:

a detection unit configured to detect a signal based on a distance between a belt surface of the first belt in the first belt suction conveyance unit and a sheet to be conveyed; and a control unit configured to control a sheet conveyance speed of the fixing unit, wherein, in a state in which a sheet is nipped and conveyed by both the transfer nip portion and the fixing nip portion, the control unit reduces the sheet conveyance speed of the fixing unit in a case where the distance between the belt surface and the sheet is a predetermined value or more and increases the sheet conveyance speed of the fixing unit in a case where the distance between the belt surface and the sheet is determined to be less than the predetermined value based on a detection result by the detection unit.

7. The image forming apparatus according to claim 6, wherein, in the state in which the sheet is nipped and conveyed by both the transfer nip portion and the fixing nip portion, the control unit controls the sheet conveyance speed of the fixing unit based on the detection result by the detection unit and performs loop control to maintain an orientation of the sheet.

* * * * *